US008281873B2

(12) United States Patent
Ullrich et al.

(10) Patent No.: US 8,281,873 B2
(45) Date of Patent: Oct. 9, 2012

(54) HAND-HELD POWER TOOL

(75) Inventors: Andre Ullrich, Filderstadt-Bernhausen (DE); Helmut Heinzelmann, Stuttgart (DE); Juergen Lennartz, Ostfildern (DE); Michael Weiss, Stuttgart (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 223 days.

(21) Appl. No.: 12/515,193

(22) PCT Filed: Oct. 16, 2007

(86) PCT No.: PCT/EP2007/061018

§ 371 (c)(1),
(2), (4) Date: May 15, 2009

(87) PCT Pub. No.: WO2008/064955

PCT Pub. Date: Jun. 5, 2008

(65) Prior Publication Data

US 2010/0051303 A1 Mar. 4, 2010

(30) Foreign Application Priority Data

Dec. 1, 2006 (DE) ..... 10 2006 056 849

(51) Int. Cl.
*E02D 7/06* (2006.01)
*B25D 15/00* (2006.01)

(52) U.S. Cl. ..... 173/48; 173/104; 173/109; 173/201

(58) Field of Classification Search ..... 173/48, 173/104, 109, 201
See application file for complete search history.

(56) References Cited

U.S. PATENT DOCUMENTS

| | | | | |
|---|---|---|---|---|
| 3,845,826 | A * | 11/1974 | Beisch | 173/48 |
| 4,895,212 | A * | 1/1990 | Wache | 173/48 |
| 5,036,925 | A * | 8/1991 | Wache | 173/48 |
| 5,277,259 | A * | 1/1994 | Schmid et al. | 173/13 |
| 5,320,177 | A * | 6/1994 | Shibata et al. | 173/48 |
| 5,588,496 | A * | 12/1996 | Elger | 173/178 |
| 6,192,996 | B1 * | 2/2001 | Sakaguchi et al. | 173/48 |
| 6,460,627 | B1 * | 10/2002 | Below et al. | 173/48 |
| 6,666,284 | B2 * | 12/2003 | Stirm | 173/97 |
| 2006/0065416 | A1 * | 3/2006 | Buchholz | 173/109 |
| 2006/0289181 | A1 | 12/2006 | Braun | |

FOREIGN PATENT DOCUMENTS

| | | | |
|---|---|---|---|
| DE | 102004026845 | A1 | 12/2005 |
| EP | 1101570 | A2 | 5/2001 |
| EP | 1533083 | A2 | 5/2005 |

* cited by examiner

*Primary Examiner* — Rinaldi Rada
*Assistant Examiner* — Nathaniel Chukwurah
(74) *Attorney, Agent, or Firm* — Maginot, Moore & Beck

(57) ABSTRACT

The invention relates to a hand-held power tool, in particular a hammer drill which has a hammer drive, a rotary drive, a switching device, and a main output element. The switching device has a slide mechanism, which is designed for switching between different operating modes. According to the invention, the slide mechanism has at least one coupling element, which in at least one operating mode is directly coupled to a coupling element, the latter being rotationally fixed to the main output element.

20 Claims, 2 Drawing Sheets

HAND-HELD POWER TOOL

CROSS-REFERENCE TO RELATED APPLICATION

This application is a 35 USC 371 application of PCT/EP 2007/061018 filed on Oct. 16, 2007.

BACKGROUND OF THE INVENTION

1. Field of the Invention

The invention is based on a hand-held power tool.

2. Description of the Prior Art

EP 1 157 788 A2 has already disclosed a hand-held power tool with a main output element, a hammering drive mode, and a rotary drive mode. The hand-held power tool has a switching device with a slide mechanism for switching between a hammering mode, a rotary mode, and a rotary hammering mode.

ADVANTAGES AND SUMMARY OF THE INVENTION

The invention is based on a hand-held power tool, in particular a rotary hammer, with a hammering drive, a rotating drive, and a switching device that has a slide mechanism that is provided for switching between different operating modes and with a main output element.

According to one proposal, the slide mechanism has at least one coupling element, which, in at least one operating mode, couples directly to a coupling element that is connected to the main output element in a rotationally fixed fashion. This makes it possible to achieve a compact switching device, which can also enable savings of additional components, space, assembly complexity, and costs, for example additional coupling elements, in particular additional gears that are supported in rotary fashion on an intermediate shaft and transmit a drive moment from the slide mechanism to the coupling element connected to the main output element in a rotationally fixed fashion. In this context, a "main output element" is understood to be an output element that in particular extends coaxial to a tool axis of a tool holder and is situated inside the impact mechanism and/or transmits a drive moment directly to the tool holder, e.g. a hammer pipe. Preferably, the coupling element of the main output element is constituted by a gear. In this context, the expression "switching between different operating modes" is understood in particular to mean a switching between a hammering mode and a hammering/rotating mode, between a hammering/rotating mode and a rotating mode, between a hammering mode and a rotating mode, or between a hammering mode, a rotating mode, and a hammering/rotating mode for a tool mounted in the hand-held power tool. In this context, the expression "rotationally fixed connection" is understood in particular to mean a connection between two components or elements by means of which when one of the two components or elements is rotated, both of the components or elements move together in the same rotation direction. In particular, the hand-held power tool is composed of a rotary hammer that has a chisel-only or hammering-only mode, a drill-only or rotary-only mode, and a combined drilling/chiseling or rotary-hammering mode for a tool driven by the hand-held power tool.

According to another proposal, the slide mechanism is constituted by a sliding sleeve permitting a particularly compact design of the slide mechanism, especially when it is situated around an intermediate shaft. The sliding sleeve is suitably situated in a rotationally fixed fashion on an intermediate shaft that is connected in rotary fashion to a drive unit or a drive shaft of the drive unit during operation of the hand-held power tool so that a drive moment is advantageously transmitted from the drive unit to the sliding sleeve via the intermediate shaft.

A structurally simple transmission of a drive moment, preferably a torque, with the slide mechanism can be advantageously achieved if the coupling element is embodied in the form of a gearing.

According to another proposal, the coupling element is formed onto the slide mechanism, thus advantageously enabling savings of additional components, space, assembly complexity, and costs.

Particularly advantageous savings of additional components, such as additional gears supported on the intermediate shaft, e.g. in an arrangement of the coupling element oriented radially inward, are possible if the coupling element is situated on a surface of the slide mechanism that is oriented radially outward.

According to another advantageous proposal, the coupling element is situated at one end of the slide mechanism in an axial direction, thus enabling the coupling element of the slide mechanism to be advantageously limited to an effective coupling region with another unit. In this context, an "axial direction" is understood in particular to be a direction along an axis, said axis being oriented perpendicular to a base surface of the slide mechanism. In this context, the expression "end of the slide mechanism" is understood in particular to mean an end region of the slide mechanism that is situated in the vicinity of an edge, in particular a terminal edge of the slide mechanism.

A particularly compact switching device and a stable arrangement of the slide mechanism can be advantageously achieved if the hand-held power tool includes an intermediate shaft on which a subregion of the slide mechanism equipped with the coupling element is directly situated.

According to another proposal, the slide mechanism is situated in an axially sliding fashion on an intermediate shaft so that during operation of the hand-held power tool, the slide mechanism or the switching device can be brought into various switching positions or operating positions by sliding it on the intermediate shaft. During operation of the hand-held power tool, depending on the position of the intermediate shaft, the slide mechanism or the coupling elements of the slide mechanism preferably transmit a drive moment to the main output element and/or to an impact mechanism or to components of the main output element and/or impact mechanism that correspond to the coupling elements of the slide mechanism.

According to a proposal in another embodiment of the invention, in one operating mode, the slide mechanism is embodied to simultaneously transmit a drive moment to a main output element and to an impact mechanism, thus permitting a compact switching device to be achieved in a structurally simple fashion. The slide mechanism preferably has a length along an axial direction, which, in at least one operating position, permits a simultaneous engagement of components of both the impact mechanism and the gear unit that engage with the slide mechanism.

BRIEF DESCRIPTION OF THE DRAWINGS

Other advantages ensue from the following description of the drawings, in which.

DESCRIPTION OF THE PREFERRED EMBODIMENT

Figure 1:
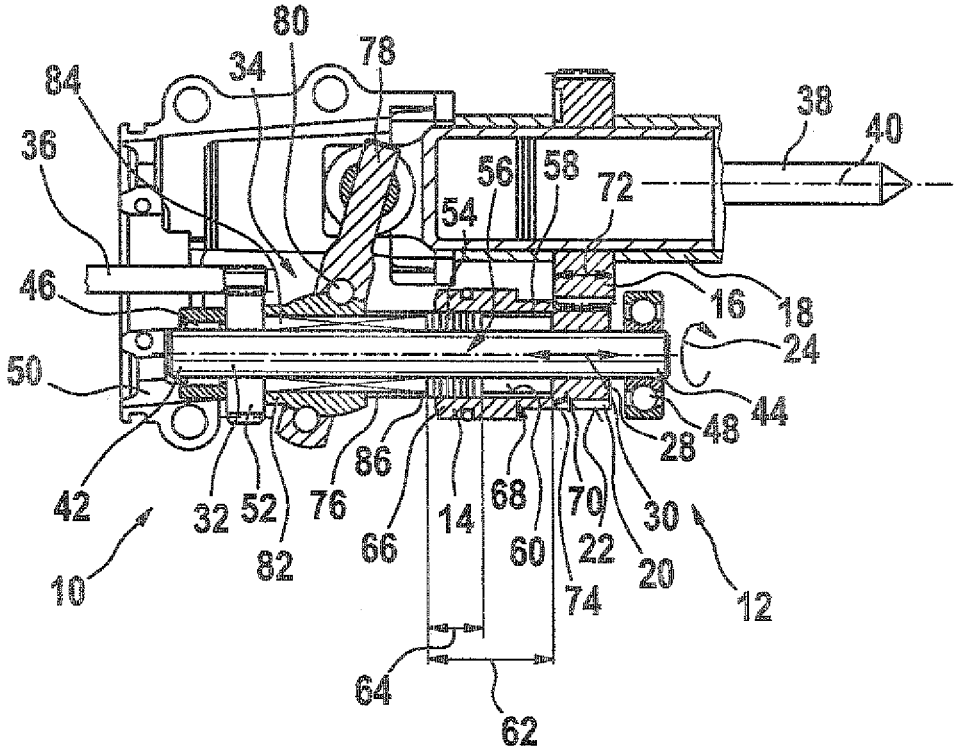
FIG. 1 is a schematic, sectional view of a detail of a hand-held power tool according to the invention, with a switching device in a drilling mode.
Figure 2:
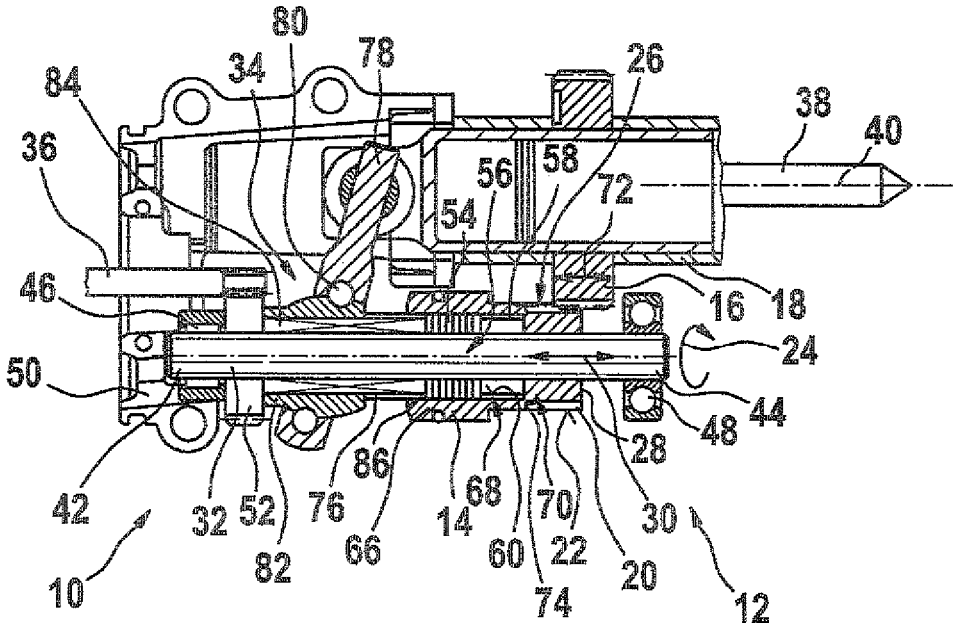
FIG. 2 is a schematic, sectional view of the hand-held power tool from FIG. 1 in a rotary hammering mode.
Figure 3:
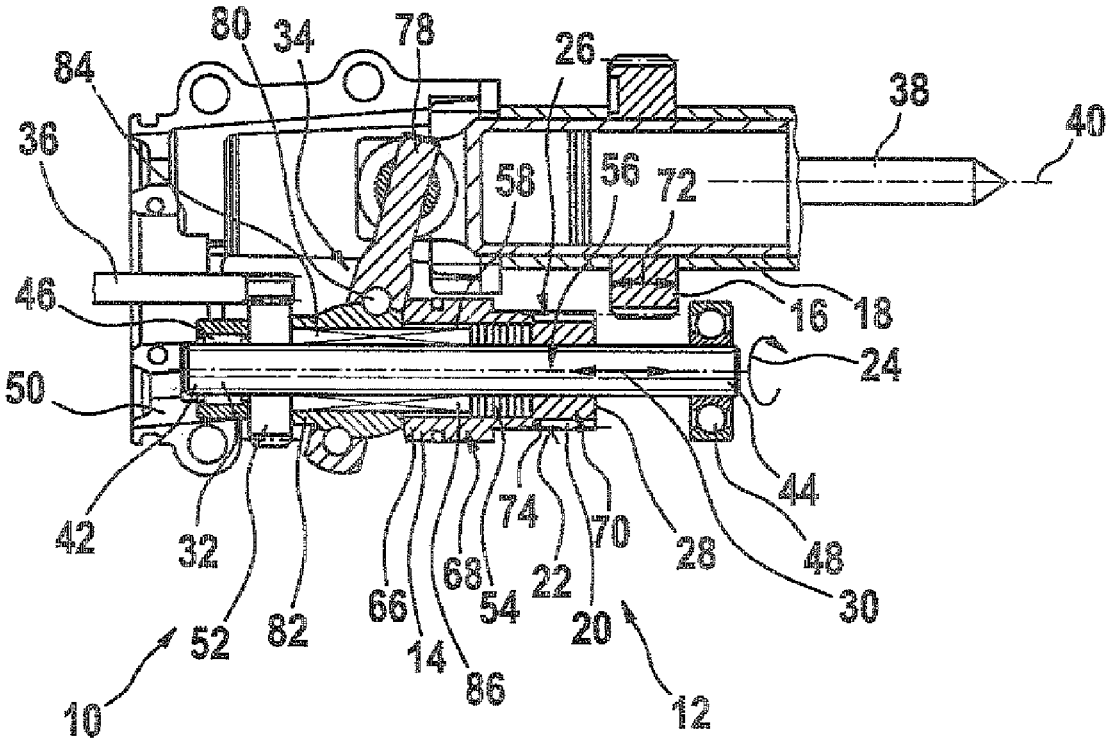
FIG. 3 is a schematic, sectional view of the hand-held power tool from FIG. 1 in a chiseling mode.

FIGS. 1 through 3 show a detail of a hand-held power tool 10 according to the invention, constituted by a rotary hammer equipped with a switching device 12. The hand-held power tool 10 includes a drive unit, not shown in detail, which is constituted by an electric motor that produces a drive moment during operation of the hand-held power tool 10 and transmits it via a drive shaft 36 to an intermediate shaft 32. During operation of the hand-held power tool 10, the intermediate shaft 32 transmits the drive moment via a slide mechanism 14 to an impact mechanism 34 and/or to a main output element 18 constituted by a hammer pipe, thus producing a rotating, a hammering, or a hammering/rotating drive mode for a tool 38 mounted in a tool holder. When the drive moment is transmitted to the main output element 18, the main output element 18 rotates around a tool axis 40, thus producing a rotating drive of the tool holder, not shown in detail in FIGS. 1 through 3, in which the tool 38 is mounted in a rotationally fixed fashion. When a drive moment is transmitted to the impact mechanism 34, this produces an impact pulse that is transmitted via an impactor, not shown in detail, to a striker, and finally to the tool 38 (FIGS. 1 through 3).

The switching device 12 includes the intermediate shaft 32 and the slide mechanism 14 constituted by a sliding sleeve, which is provided for switching between different drive modes of the hand-held power tool. In an axial direction 30 that extends parallel to the tool axis 40, the intermediate shaft 32 is supported in rotary fashion in a hand-held power tool housing 50 by means of two pivot bearings 46, 48 situated at an end 42 oriented toward a drive side and at an end 44 oriented toward an output side. The drive shaft 36 has a gearing, not shown in detail, which engages in a form-locked fashion with a gear 52 that corresponds to the gearing. The gear 52 is situated in a rotationally fixed fashion on the intermediate shaft 32 so that the intermediate shaft 32 always rotates with the drive unit during operation of the hand-held power tool 10 and, via the intermediate shaft 32, a drive moment is transmitted from the drive unit via the gear 52 to the intermediate shaft 32 (FIGS. 1 through 3).

In order to switch between the various drive modes, the slide mechanism 14 is mounted in a rotationally fixed fashion to the intermediate shaft 32, which has a drive gearing 54 for this purpose. The drive gearing 54 is connected to the intermediate shaft 32 in a rotationally fixed fashion in the circumferential direction 24 of the intermediate shaft 32, in a subregion 56 of the intermediate shaft 32 situated in its middle in the axial direction 30. On a radially outward oriented side, the drive gearing 54 has a gearing that engages in a form-locked fashion with an internal gearing 58 of the slide mechanism 14 that corresponds to the drive gearing 54; the internal gearing 58 is situated in the circumferential direction 24 of the slide mechanism 14, on a cylindrical circumferential surface 60 that is oriented radially inward (FIGS. 1 and 2). The internal gearing 58 of the slide mechanism 14 in this case has a greater length 62 in the axial direction 30 than a length 64 of the drive gearing 54 (FIG. 1) so that an operator of the hand-held power tool 10 can slide the slide mechanism 14 in the axial direction 30 of the intermediate shaft 32 in order to switch the hand-held power tool 10 into various drive modes. Independent of the various switching positions along the intermediate shaft 32, the slide mechanism 14 here is always connected to the intermediate shaft 32 in a rotationally fixed fashion by means of the drive gearing 54 and the internal gearing 58 of the slide mechanism 14.

The internal gearing 58 extends from a drive end 66 of the slide mechanism 14 toward the tool 38, approximately two thirds of the way into the slide mechanism 14 in its axial direction 30. The slide mechanism 14 is embodied as stepped on a side oriented inward, with a subregion 68 that includes the internal gearing 58 having a larger inner cross-sectional area than a subregion 70 of the slide mechanism 14 oriented toward the tool 38. The subregion 70 of the slide mechanism 14 with the smaller cross-sectional area is mounted directly on the intermediate shaft 32 in this instance (FIGS. 1 through 3).

During operation of the hand-held power tool 10, the slide mechanism 14 assumes different switching positions along the intermediate shaft 32 in the axial direction 30 (FIGS. 1 trough 3). In a first switching position in which the switching device 12 or the slide mechanism 14 switches into a drill-only mode of the hand-held power tool 10 the slide mechanism 14 is brought into a front position toward the driven side (FIG. 1) by means of an actuating element, not shown in detail, that can be actuated by an operator. In this case, the slide mechanism 14 transmits a drive moment exclusively to the main output element 18 or to a coupling element 16 of the main output element 18 so that the main output element 18 executes a rotary motion and the main output element 18 moves the tool 38 in the tool holder in a drill-only mode. The coupling element 16 is connected to the main output element 18 in a rotationally fixed fashion.

In order to transmit a rotating drive to the coupling element 16 of the main output element 18, which coupling element is embodied in the form of a gear, the slide mechanism 14 has a coupling element 20 in the subregion 70 that is situated at a driven end 28 and is situated directly around the intermediate shaft 32. The coupling element 20, which is constituted by a gearing corresponding to the coupling element 16 of the main output element 18, is integrally formed onto the slide mechanism 14 on a surface 22 of the slide mechanism 14 that is oriented radially outward. In the axial direction 30, the gearing of the coupling element 20 includes a length 72 of the coupling element 16 of the main output element 18 so that with a drill-only mode of the tool 38 in the tool holder, a maximal engagement is achieved between the coupling element 20 of the slide mechanism 14 and the coupling element 16 of the main output element 18 (FIG. 1).

A stop element 74 is situated between the coupling element 20 of the slide mechanism 14 and the radially outward-oriented surface 22 of the slide mechanism 14 that adjoins the coupling element 20 in the axial direction 30. The stop element 74 is embodied in the form of a shoulder between an inner radius of the coupling element 20 of the slide mechanism 14 and the radially outward-oriented surface 22 of the slide mechanism 14 that adjoins the coupling element 20. When the slide mechanism 14 is slid toward the tool 38, the coupling element 16 of the main output element 18 is brought into contact with the stop element 74 so that a further, undesirable sliding of the slide mechanism 14 is prevented and the slide mechanism 14 or the internal gearing 58 of the slide mechanism 14 remains in an operative connection with the drive gearing 54 of the intermediate shaft 32.

In another switching position of the slide mechanism 14, the slide mechanism 14 simultaneously transmits a drive moment to the coupling element 16 of the main output element 18 and to the impact mechanism 34 or to a coupling element 76 of the impact mechanism 34 (FIG. 2). To accomplish this, the slide mechanism 14 is slid along the axial direction 30 of the intermediate shaft 32 into a middle switching position in which the coupling element 20 of the slide mechanism 14 remains engaged with the coupling element 16 of the main output element 18 while the internal gearing 58 of the slide mechanism 14 at the drive end 66 also engages with the coupling element 76 of the impact mechanism 34. The hand-held power tool 10 thus simultaneously executes a drilling and chiseling motion for a tool 38. The impact mechanism 34 includes a wobble pin 78 that a ball bearing 80 supports on a wobble sleeve 82. A bearing 84 constituted by a needle bearing supports the wobble sleeve 82 in a freely rotating fashion on the intermediate shaft 32 at its end 42 oriented toward the drive unit. In addition, the wobble sleeve 82 is supported around the intermediate shaft 32 in a way that does not allow it to move in the axial direction 30. At its driven end 86, the wobble sleeve 82 has the coupling element 76, which is constituted by a gearing that corresponds to the internal gearing 58 of the slide mechanism 14 and is integrally formed onto the wobble sleeve 82 (FIG. 1). Via the internal gearing 58 of the slide mechanism 14, the torque is transmitted to the coupling element 76 and therefore to the wobble sleeve 82, thus driving the impact mechanism 34.

In a third switching position of the slide mechanism 14 on the intermediate shaft 32, the shaft transmits a drive moment only to the impact mechanism 34 (FIG. 3). In this case, the slide mechanism 14 is situated on the intermediate shaft 32 in an end position oriented toward the drive unit; the internal gearing 58 of the slide mechanism 14 engages the coupling element 76 of the wobble sleeve 82 completely in the axial direction 30. The coupling element 20 of the slide mechanism 14 and the coupling element 16 of the main output element 18 are in position in which they are disengaged from each other so that the hand-held power tool 10 operates in a chisel-only mode.

The foregoing relates to the preferred exemplary embodiment of the invention, it being understood that other variants and embodiments thereof are possible within the spirit and scope of the invention, the latter being defined by the appended claims.

The invention claimed is:

1. A hand-held power tool, in particular a rotary hammer, having a hammering-only mode, a rotary-hammering mode and a rotary-only mode, comprising:

a switching device equipped with a slide mechanism that switches between the hammering-only mode, the rotary-hammering mode and the rotary-only mode of the rotary hammer;

a main output element; and at least one slide mechanism coupling element situated on a circumferential surface of the slide mechanism that is oriented radially outward, wherein the at least one slide mechanism coupling element, in at least one of the rotary-only mode and the rotary-hammering mode, is directly coupled to a main output element coupling element which is connected to the main output element in a rotationally fixed fashion, and wherein the at least one slide mechanism coupling element, in the hammering-only mode, is disengaged from the main output element coupling element.

2. The hand-held power tool as recited in claim 1, wherein the slide mechanism is embodied by a sliding sleeve.

3. The hand-held power tool as recited in claim 2, wherein the at least one slide mechanism coupling element is embodied by a gearing.

4. The hand-held power tool as recited in claim 3, wherein the at least one slide mechanism coupling element is integrally formed onto the circumferential surface of the sliding sleeve that is oriented radially outward.

5. The hand-held power tool as recited in claim 2, wherein the at least one slide mechanism coupling element is integrally formed onto the circumferential surface of the sliding sleeve that is oriented radially outward.

6. The hand-held power tool as recited in claim 1, wherein the at least one slide mechanism coupling element is embodied by a gearing.

7. The hand-held power tool as recited in claim 6, wherein the gearing is integrally formed onto the circumferential surface of the slide mechanism that is oriented radially outward.

8. The hand-held power tool as recited in claim 6, wherein the at least one slide mechanism coupling element is situated at one end of the slide mechanism in an axial direction.

9. The hand-held power tool as recited in claim 8, wherein a subregion of the slide mechanism equipped with the at least one slide mechanism coupling element is mounted directly on an intermediate shaft.

10. The hand-held power tool as recited in claim 9, wherein the slide mechanism is situated on the intermediate shaft in an axially sliding fashion.

11. The hand-held power tool as recited in claim 9, wherein the slide mechanism transmits a drive moment simultaneously to the main output element and to an impact mechanism in the rotary-hammering mode.

12. The hand-held power tool as recited in claim 1, wherein the at least one slide mechanism coupling element is situated at one end of the slide mechanism in an axial direction.

13. The hand-held power tool as recited in claim 1, wherein a subregion of the slide mechanism equipped with the at least one slide mechanism coupling element is mounted directly on an intermediate shaft.

14. The hand-held power tool as recited in claim 13, wherein the slide mechanism is situated on the intermediate shaft in an axially sliding fashion.

15. The hand-held power tool as recited in claim 1, wherein the slide mechanism transmits a drive moment simultaneously to the main output element and to an impact mechanism in the rotary-hammering mode.

16. The hand-held power tool as recited in claim 15, wherein the impact mechanism includes a wobble sleeve having a wobble pin attached thereto, wherein the wobble sleeve has a coupling element constituted by a gearing integrally formed on the sleeve that corresponds to a gearing on the slide mechanism.

17. The hand-held power tool as recited in claim 1, wherein the slide mechanism is mounted to an intermediate shaft on which a drive gearing is connected in a rotationally fixed fashion in the circumferential direction on a radially outward oriented side of the intermediate shaft, wherein the slide mechanism is embodied by a sliding sleeve having an internal gearing situated in a circumferential direction on a circumferential surface of the slide mechanism that is oriented radially inward and engages the drive gearing, and wherein the internal gearing of the slide mechanism has a greater length in an axial direction than a length of the drive gearing.

18. The hand-held power tool as recited in claim 17, wherein the internal gearing extends from a drive end of the sliding sleeve only partially into the sliding sleeve in an axial direction.

19. The hand-held power tool as recited in claim 17, wherein the sliding sleeve is embodied as stepped on a side oriented inward with a subregion that includes the internal gearing having a larger inner cross-sectional area than a subregion of the sliding sleeve oriented toward a driven end of the sliding sleeve.

20. The hand-held power tool as recited in claim 19, wherein the subregion of the sliding sleeve with the smaller cross-sectional area is mounted directly on the intermediate shaft.

* * * * *